US011297706B2

(12) United States Patent
Ye et al.

(10) Patent No.: US 11,297,706 B2
(45) Date of Patent: Apr. 5, 2022

(54) DETECTION CIRCUIT AND DEVICE OF TRIAC DIMMER AND DETECTION METHOD

(71) Applicant: SHENZHEN SENDIS SEMICONDUCTOR CO., LTD, Shenzhen (CN)

(72) Inventors: Yu'An Ye, Shenzhen (CN); Xunsheng Deng, Shenzhen (CN); Wenpan Wang, Shenzhen (CN)

(73) Assignee: SHENZHEN SENDIS SEMICONDUCTOR CO., LTD

( * ) Notice: Subject to any disclaimer, the term of this patent is extended or adjusted under 35 U.S.C. 154(b) by 0 days.

(21) Appl. No.: 17/378,445

(22) Filed: Jul. 16, 2021

(65) Prior Publication Data

US 2022/0053623 A1 Feb. 17, 2022

(30) Foreign Application Priority Data

Aug. 13, 2020 (CN) ..... 202010813274.8

(51) Int. Cl.

| | |
|---|---|
| ***H05B 45/50*** | (2022.01) |
| ***H05B 45/3575*** | (2020.01) |
| ***H05B 45/14*** | (2020.01) |
| ***F21S 4/24*** | (2016.01) |
| *F21Y 115/10* | (2016.01) |

(52) U.S. Cl.

CPC ..... *H05B 45/50* (2020.01); *F21S 4/24* (2016.01); *H05B 45/14* (2020.01); *F21Y 2115/10* (2016.08)

(58) Field of Classification Search

None

See application file for complete search history.

(56) References Cited

U.S. PATENT DOCUMENTS

2015/0366018 A1* 12/2015 Kuang ..... H05B 45/14 315/206
2015/0366019 A1* 12/2015 Kuang ..... H05B 45/385 315/206
2019/0150240 A1* 5/2019 Yu ..... H05B 45/31 315/200 R

* cited by examiner

*Primary Examiner* — Anh Q Tran
(74) *Attorney, Agent, or Firm* — Hayes Soloway P.C.

(57) ABSTRACT

Disclosed are detection circuit and device of TRIAC dimmer and detection method. Detection circuit comprises line voltage sampling module, peak voltage sampling module, average voltage sampling module, judgment module, bleeder module, line voltage sampling module samples line voltage, outputs sampling voltage to peak voltage sampling module and average voltage sampling module; peak voltage sampling module outputs first comparison voltage to judgment module according to sampling voltage, average voltage sampling module outputs second comparison voltage to judgment module according to sampling voltage; judgment module compares first comparison voltage with second comparison voltage and outputs control signal according to comparison result to control connection or disconnection of bleeder module; bleeder module provides discharge current for TRIAC dimmer when being connected. According to invention, problem that detection result of TRIAC dimmer is unreliable can be effectively solved, and detection accuracy is improved.

11 Claims, 6 Drawing Sheets

DETECTION CIRCUIT AND DEVICE OF TRIAC DIMMER AND DETECTION METHOD

CROSS-REFERENCES TO RELATED APPLICATIONS

This application claims priority to Chinese Patent Application No. 202010813274.8, filed on 13 Aug. 2020, the content of all of which is incorporated herein by reference.

FIELD OF THE INVENTION

The present disclosure relates to the technical field of LED lighting, and, more particularly, to a detection circuit and a device for a TRIAC dimmer and a detection method thereof.

BACKGROUND

Currently, detecting if a Triode AC semiconductor switch (TRIAC) dimmer is connected to an AC grid or not, is by detecting an average value of an AC grid voltage and comparing a value thereof with a fixed reference voltage value, before determining whether the TRIAC dimmer is connected to the AC grid or not. When there is a TRIAC dimmer connected to an AC grid, an average voltage value obtained after an AC voltage is phase-cut by the TRIAC dimmer will be less than an average voltage value when there is no TRIAC dimmer connected. By setting a fixed reference voltage and comparing with the average voltage value, it is able to determine whether a TRIAC dimmer is connected to the AC grid or not. However, a method stated above, wherein due to a voltage applied to comparing with the average voltage value is a fixed reference voltage, when a fluctuation of the AC grid voltage causes the average voltage value to change, the average value changes while the reference voltage does not change, resulting in a detection result unreliable and a false detection risk high.

Therefore, the current technology needs to be improved and developed.

BRIEF SUMMARY OF THE DISCLOSURE

According to the above described defects, the purpose of the present disclosure is providing a detection circuit and a device of a TRIAC dimmer and a detection method thereof, in order to achieve a purpose of being able to effectively solve the problem in the prior art that, a detection result on the TRIAC dimmer is unreliable when the average voltage value changes due to the fluctuation of the AC grid voltage while the reference voltage does not change.

A technical solution of the present disclosure to solve the technical problems is as follows:

a detection circuit of a TRIAC dimmer, wherein comprising a line voltage sampling module, a peak voltage sampling module, an average voltage sampling module, a judgment module and a bleeder module; the line voltage sampling module is applied to sampling the line voltage before outputting respectively a sampling voltage to the peak voltage sampling module and the average voltage sampling module; the peak voltage sampling module is applied to outputting a first comparison voltage to the judgment module according to the sampling voltage, the average voltage sampling module is applied to outputting a second comparison voltage to the judgment module according to the sampling voltage; the judgment module is applied to comparing the first comparison voltage with the second comparison voltage, before outputting a control signal to control an on or off of the bleeder module according to a comparison result; and the bleeder module is applied to providing a discharge current for the TRIAC dimmer when being turned on.

The detection circuit, wherein the peak voltage sampling module is applied specifically to multiplying a peak voltage of the sampling voltage by a preset value before outputting the first comparison voltage to the judgment module.

The detection circuit, wherein the peak voltage sampling module comprises a first source following unit and a second source following unit; the first source following unit is applied to multiplying the sampling voltage by a preset value before outputting the detection voltage to the second source following unit; the second source following unit is applied to obtaining a peak voltage of the detection voltage according to the detection voltage, before outputting the first comparison voltage to the judgment module.

The detection circuit, wherein the judgment module comprises a judgment unit and a control unit; the judgment unit is applied to outputting a first comparison signal to the control unit when judging the first comparison voltage larger than the second comparison voltage, and outputting a second comparison signal to the control unit when judging the first comparison voltage smaller than the second comparison voltage; the control unit is applied to controlling the bleeder module on according to the first comparison signal, or controlling the bleeder module off according to the second comparison signal.

The detection circuit, wherein the first source following unit comprises a first operational amplifier, a first MOS transistor, a first resistor, and a second resistor; a non-inverting input terminal of the first operational amplifier is connected to the line voltage sampling module, and an inverting input terminal of the first operational amplifier is connected to a source of the first MOS transistor and one end of the first resistor, another end of the first resistor and one end of the second resistor are both connected to the second source following unit; an output terminal of the first operational amplifier connects to a gate of the first MOS transistor, a drain of the first MOS transistor is connected to a power, another end of the second resistor is grounded.

The detection circuit, wherein the second source following unit comprises a second operational amplifier, a second MOS transistor, a third resistor, and a first capacitor; a non-inverting input terminal of the second operational amplifier connects to another end of the first resistor and one end of the second resistor, an inverting input terminal of the second operational amplifier connects to one end of the first capacitor, one end of the third resistor and the judgment module; an output terminal of the second operational amplifier connects to a gate of the second MOS transistor, a drain of the second MOS transistor connects to a power, a source of the second MOS transistor connects to one end of the third resistor, another end of the third resistor gets grounded, another end of the first capacitor gets grounded.

The detection circuit, wherein the average voltage sampling module comprises a third operational amplifier, a fourth resistor and a second capacitor; a non-inverting input terminal of the third operational amplifier connects to the line voltage sampling module, an inverting input terminal and an output terminal of the third operational amplifier are both connected to one end of the fourth resistor, another end of the fourth resistor connects to one end of the second capacitor and the judgment module, another end of the second capacitor gets grounded.

The detection circuit, wherein the average voltage sampling module comprises a third capacitor, one end of the third capacitor connects to the line voltage sampling module and the judgment module respectively, another end of the third capacitor gets grounded.

A detection method according to the detection circuit stated above, comprising a plurality of following steps:

sampling the line voltage by the line voltage sampling module before outputting respectively a sampling voltage to the peak voltage sampling module and the average voltage sampling module;

outputting a first comparison voltage by the peak voltage sampling module to the judgment module according to the sampling voltage, outputting a second comparison voltage by the average voltage sampling module to the judgment module according to the sampling voltage;

comparing the first comparison voltage with the second comparison voltage by the judgment module, before outputting a control signal to control the bleeder module on according to a comparison result, to provide a discharge current to the TRIAC dimmer, or control the bleeder module off.

A detection device for the TRIAC dimmer, comprising a PCB, the PCB has the detection circuit stated above arranged thereon.

Comparing to the prior art, the present disclosure provides a detection circuit and a device for a TRIAC dimmer and a detection method thereof. The detection circuit comprises a line voltage sampling module, a peak voltage sampling module, an average voltage sampling module, a judgment module and a bleeder module, wherein the line voltage sampling module is applied to sampling the line voltage before outputting respectively a sampling voltage to the peak voltage sampling module and the average voltage sampling module; the peak voltage sampling module outputs a first comparison voltage to the judgment module according to the sampling voltage, and the average voltage sampling module outputs a second comparison voltage to the judgment module according to the sampling voltage; the judgment module is applied to comparing the first comparison voltage with the second comparison voltage before outputting a control signal according to a comparison result to control the bleeder module on or off; and the bleeder module is applied to providing a discharge current to the TRIAC dimmer when being on. The present disclosure is able to solve effectively the problem that the detection result for the TRIAC dimmer is unreliable when an average voltage value is changed while a reference voltage is not changed due to a fluctuation of an AC grid voltage, and a detection accuracy is improved.

DETAILED DESCRIPTION OF EMBODIMENTS

The present disclosure provides a detection circuit and a device for a TRIAC dimmer and a detection method thereof, being able to solve effectively a problem in the prior art that a detection result for the TRIAC dimmer is unreliable when an average voltage value is changed while a reference voltage is not changed due to a fluctuation of an AC grid voltage.

In order to make the purpose, technical solution and the advantages of the present disclosure clearer and more explicit, further detailed descriptions of the present disclosure are stated herein, referencing to the attached drawings and some embodiments of the present disclosure. It should be understood that the detailed embodiments of the disclosure described herein are used to explain the present disclosure only, instead of limiting the present disclosure.

Figure 1:
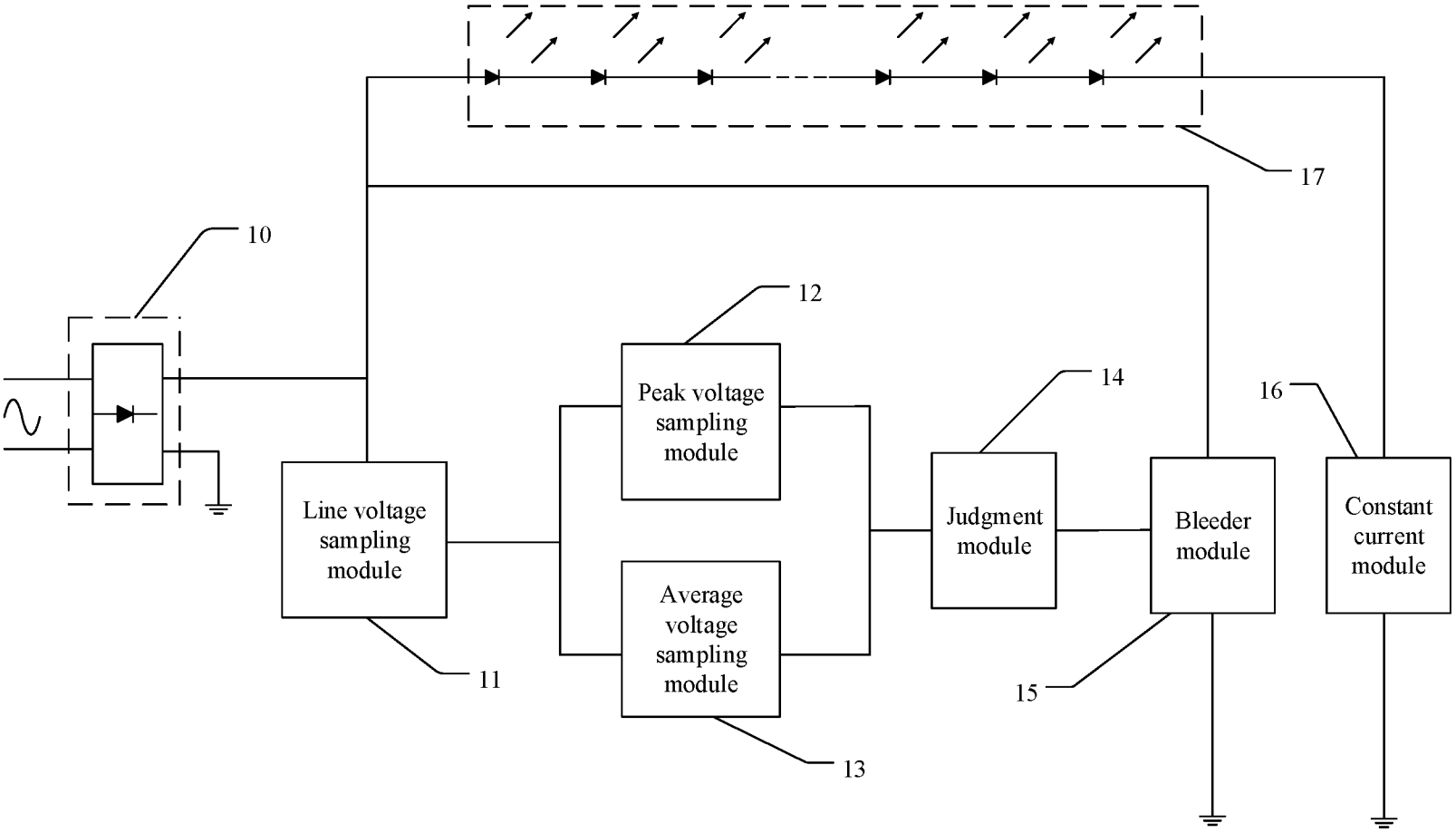
FIG. 1 illustrates a structural block diagram on the detection circuit of the TRIAC dimmer provided by the present disclosure.

Referencing to FIG. 1, a detection circuit of a Triode AC semiconductor switch (TRIAC) dimmer provided by the present disclosure, comprises a rectifier bridge 10, a line voltage sampling module 11, a peak voltage sampling module 12, an average voltage sampling module 13, a judgment module 14 and a bleeder module 15, a constant current module 16 and an LED light string 17. The rectifier bridge 10 connects to an AC power and the line voltage sampling module 11, the line voltage sampling module 11 further connects to the peak voltage sampling module 12 and the average voltage sampling module 13 respectively. Both the peak voltage sampling module 12 and the average voltage sampling module 13 connects to the judgment module 14. The judgment module 14 further connects to the bleeder module 15, the bleeder module 15 further connects to the rectifier bridge 10, the constant current module 16 connects to an output terminal of the LED light string 17, an input terminal of the LED light string 17 connects to the rectifier bridge 10.

In a real implementation, the rectifier bridge 10 rectifies an AC before outputting a line voltage to the LED light string 17 to power the LED light string 17, and further outputting the line voltage to the line voltage sampling module 11 to facilitate a subsequent determination whether an AC grid has a TRIAC dimmer or not. The line voltage sampling module 11 is applied to sampling the line voltage before outputting respectively a sampling voltage to the peak voltage sampling module 12 and the average voltage sampling module 13; the peak voltage sampling module 12 outputs a first comparison voltage to the judgment module 14 according to the sampling voltage, the average voltage sampling module 13 outputs a second comparison voltage to the judgment module 14 according to the sampling voltage; the judgment module 14 is applied to comparing the first comparison voltage with the second comparison voltage, before outputting a control signal to control an on or off of the bleeder module 15 according to a comparison result. Specifically, when the first comparison voltage is greater than the second comparison voltage, it indicates that there is a TRIAC dimmer connected to the AC grid, and the judgment module 14 controls the bleeder module 15 to be on, so the bleeder module 15 is applied to, when being on, providing a discharge current to the TRIAC dimmer. While the first comparison voltage is less than the second comparison voltage, it indicates that there is no TRIAC dimmer connected to the AC grid, and the judgment module 14 controls the bleeder module 15 to be off, instead of being on, wherein, a constant current source is applied to arranging a constant current value for the LED light string 17. The first comparison voltage in the present invention is sampled and converted based on the line voltage, having a certain correlation with a peak voltage of the line voltage, thus when the peak voltage of the line voltage changes, the first comparison voltage will also change accordingly, instead of being fixed. Thus by comparing the second comparison voltage with the first comparison voltage, it is able to solve effectively the problem that the detection result for the TRIAC dimmer is unreliable when an average voltage value is changed while a reference voltage is not changed due to a fluctuation of the AC grid voltage, and a detection accuracy is improved.

Further, the peak voltage sampling module 12 is applied specifically to multiplying a peak voltage of the sampling voltage by a preset value before outputting the first comparison voltage to the judgment module 14. Wherein the preset value is set according to a specific structure of the peak voltage sampling module 12, and in the present embodiment, the preset value is slightly less than $2/\pi$.

Figure 2:
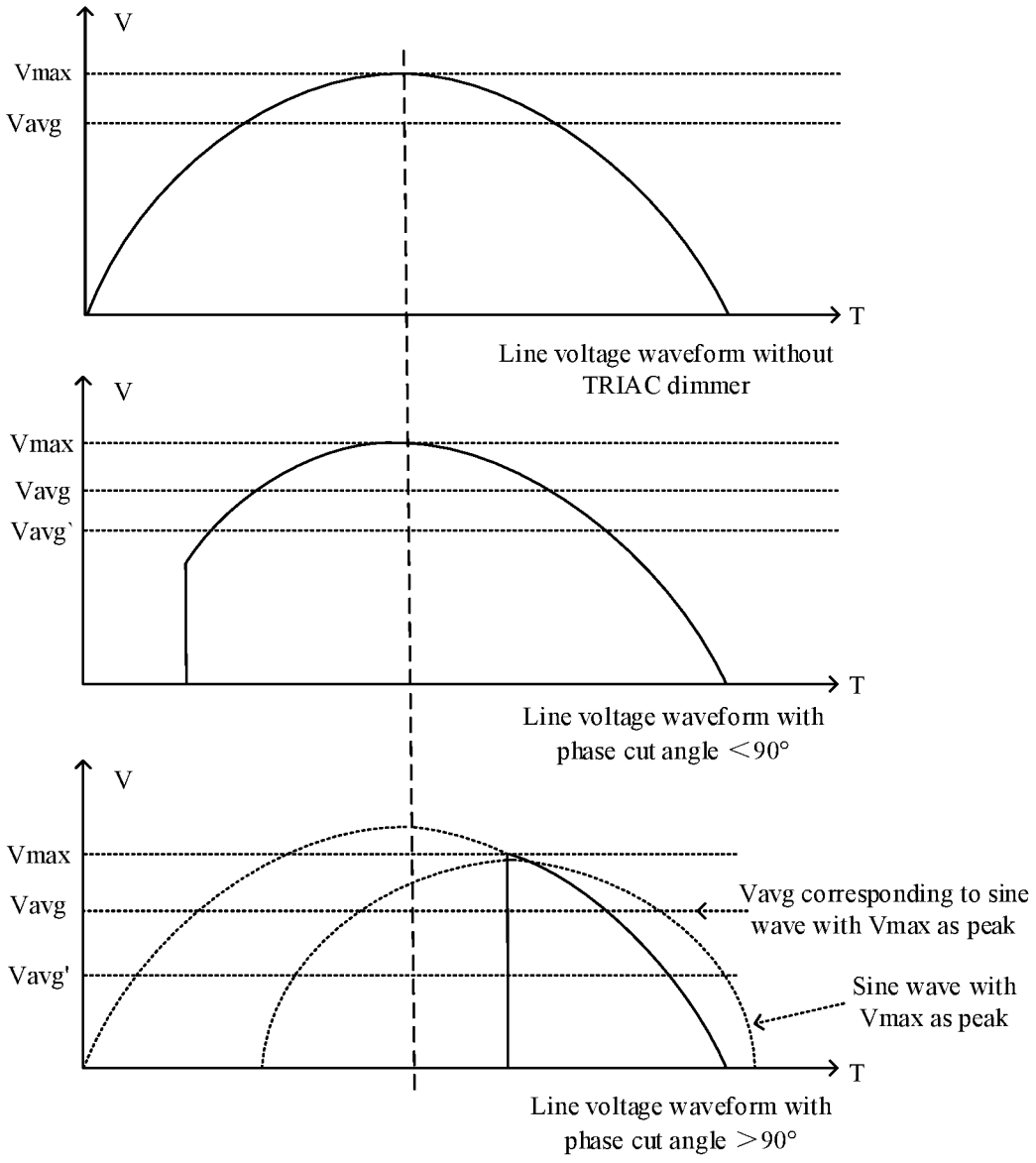
FIG. 2 illustrates a line voltage waveform comparison chart on a phase cut angle less than and greater than 90 degrees, when the detection circuit of the TRIAC dimmer has no TRIAC dimmer arranged and has a TRIAC dimmer arranged, as provided by the present disclosure.

Specifically, referencing to FIG. 2, when the AC grid has no TRIAC dimmer connected, an effective voltage of the AC is Vac, after being rectified by the rectifier bridge 10, a line voltage is output, while a peak voltage thereof is $Vmax=\sqrt{2}Vac$, and an average voltage thereof is Vavg. The average voltage is an average value of the line voltage in one cycle, that is, $Vavg=Vmax\int_0^{\pi}\sin\theta d\theta$, it obtains the average voltage $Vavg=(2/\pi)Vmax$; if the AC grid has the TRIAC dimmer connected, the TRIAC dimmer, by cutting off a phase of a part of the AC voltage, reduces an average voltage after being rectified by the rectifier bridge 10, thereby realizing a dimming function. When the AC grid has the TRIAC dimmer connected, a line voltage corresponding to the AC voltage is phase-cut, and when the phase-cut is less than or equal to 90 degrees, a peak voltage Vmax is the same as that when the TRIAC dimmer is not connected, and when the phase-cut is greater than 90 degrees, the peak voltage Vmax is various according to an amount of a phase of the line voltage being cut. According to $Vavg=Vmax\cdot_0^{\pi}\sin\theta d\theta$, it is known that, due to the AC grid has a part of the phase being cut when having the TRIAC dimmer connected, an average voltage of the AC grid having no TRIAC dimmer connected must be larger than an average voltage of the AC grid having the TRIAC dimmer connected.

When the AC grid has no TRIAC dimmer connected, an AC grid voltage is a complete sine wave, by sampling the peak value Vmax of the line voltage, it is able to calculate an average voltage thereof $Vavg=(2/\pi)Vmax$, and by sampling the average voltage of the line voltage, it obtains $Vavg'=(2/\pi)Vmax$. After the TRIAC dimmer is connected, a phase angle of the line voltage being cut off is $\alpha$. By sampling the peak value Vmax of the line voltage after being phase cut, it is able to calculate and obtain the average voltage of the complete sine wave as $Vavg=(2/\pi)Vmax$, wherein the complete sine wave is obtained by taking the peak value Vmax as the peak value of the sine wave. By sampling the average voltage of the line voltage after being phase cut, it obtains $Vavg'=Vmax\int_{\alpha}^{\pi}\sin\theta d\theta$. The peak value of the line voltage Vmax obtained by sampling is multiplied by a coefficient Kt, while the Kt is slightly less than $2/\pi$, it makes $Vavg'<Kt*Vmax<Vavg$. Then it is judged whether the AC grid has the TRIAC dimmer connected or not by judging a size relationship between Kt*Vmax and Vavg'. That is, when $Kt*Vmax>Vavg'$, the AC grid has a TRIAC dimmer connected, otherwise it has no TRIAC dimmer connected.

The present embodiment, wherein the second comparison voltage is obtained by sampling the average voltage of the sampling voltage, while the sampling voltage is obtained by sampling the line voltage, accordingly, the peak voltage of the sampling voltage is correlated to the peak voltage of the line voltage, and the average voltage of the sampling voltage is correlated to the average voltage of the line voltage. By setting a preset value, that is, a coefficient Kt. The peak voltage of the sampling voltage is multiplied by the preset value before compared to the second comparison voltage, which equals to comparing the peak voltage of the line voltage after multiplied by the preset value to the average voltage of the line voltage being sampled, before determining whether a TRIAC dimmer is connected to the AC grid.

Figure 3:
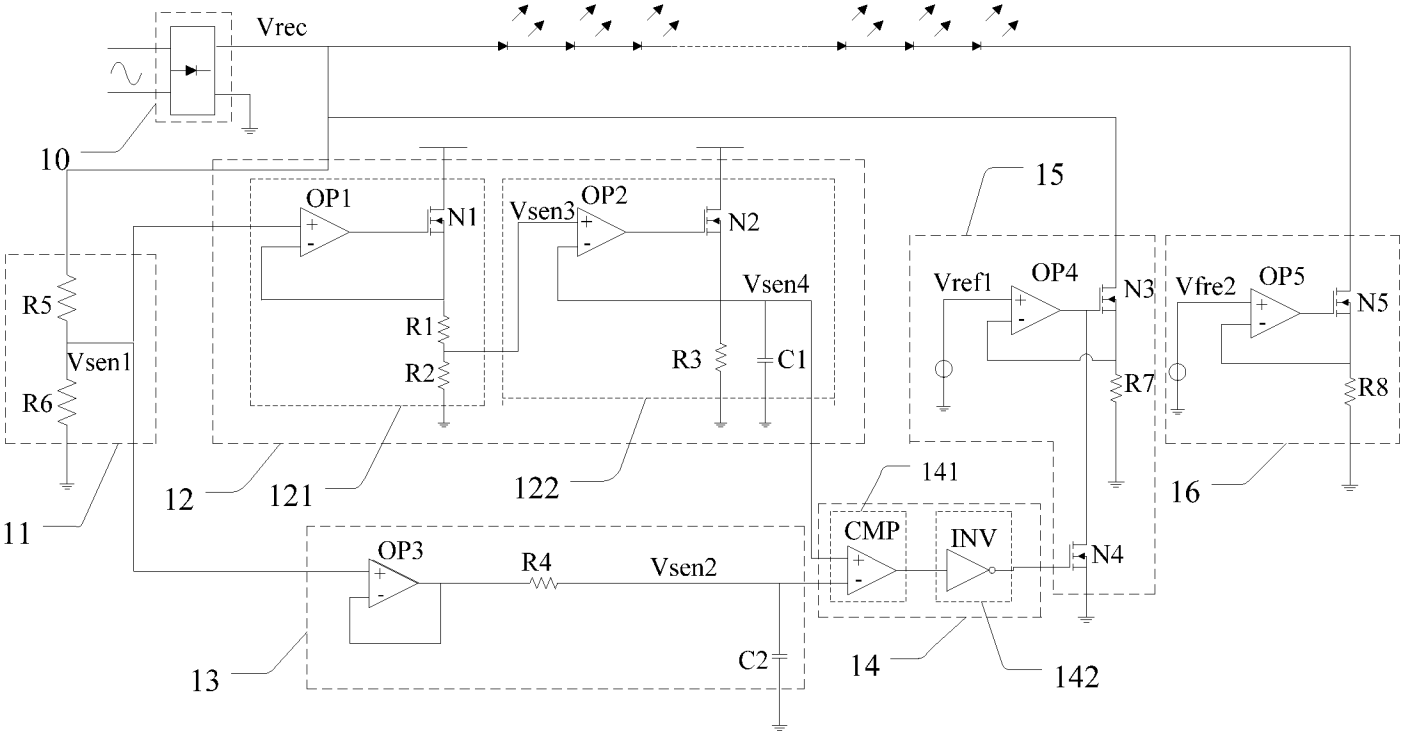
FIG. 3 illustrates a circuit schematic diagram on a first embodiment of the detection circuit of the TRIAC dimmer provided by the present disclosure.

Further, referencing to FIG. 3 together, the judgment module 14 comprises a judgment unit 141 and a control unit 142, the judgment unit 141 connects to the peak voltage sampling module 12, the average voltage sampling module 13 and the control unit 142, the control unit 142 further connects to the bleeder module 15. the judgment unit 141 is applied to outputting a first comparison signal to the control unit 142 when judging the first comparison voltage larger than the second comparison voltage, and outputting a second comparison signal to the control unit 142 when judging the first comparison voltage smaller than the second comparison voltage. The control unit 142 is applied to controlling the bleeder module 15 on according to the first comparison signal, or controlling the bleeder module 15 off according to the second comparison signal. The present embodiment, wherein the first comparison signal is a high-level signal, the second comparison signal is a low-level signal, when the first comparison voltage is larger than the second comparison voltage, the judgment unit 141 outputs a high-level signal, then the control unit 142 outputs a low-level signal according to the high-level signal, to control the bleeder module 15 on to maintain a discharge circuit of the TRIAC dimmer, that also indicates there is a TRIAC dimmer connected to the AC grid. Otherwise, when the first comparison voltage is less than the second comparison voltage, the judgment unit 141 outputs a low-level signal, then the control unit 142 outputs a high-level signal according to the low-level signal, to control the bleeder module 15 off, that also indicates there is no TRIAC dimmer connected to the AC grid. Thus it is able to determine effectively if the AC grid has the TRIAC dimmer arranged according to a size of the first comparison voltage and that of the second comparison voltage.

Further, continue referencing to FIG. 3, a first embodiment of the present invention, wherein the peak voltage sampling module 12 comprises a first source following unit 121 and a second source following unit 122; the first source following unit 121 connects to the line voltage sampling module 11 and the second source following unit 122 respectively, the second source following unit 122 connects to the judgment unit 141. Wherein the first source following unit 121 is applied to multiplying the sampling voltage by a preset value before outputting the detection voltage to the second source following unit 122, the second source following unit 122 is applied to obtaining a peak voltage of the detection voltage according to the detection voltage, before outputting the first comparison voltage to the judgment unit 141. In the present embodiment, the first comparison voltage is the peak voltage of the detection voltage, after multiplying the sampling voltage by the preset value, accordingly the peak voltage of the sampling voltage is multiplied by the preset value. Since the detection voltage is obtained by multiplying the sampling voltage with the preset value, thus the peak voltage of the detecting voltage is obtained by the peak voltage of the sampling voltage multiplying the preset value. Due to the sampling voltage is obtained by the line voltage sampling module 11 sampling the line voltage, the peak value of the sampling voltage correlates to the peak voltage of the line voltage, thus the first comparison voltage changes following a change of the peak voltage of the line voltage, so as to facilitate to detect accurately if there is a TRIAC dimmer connected to the AC grid when the line voltage fluctuates Further, the first source following unit 121 comprises a first operational amplifier OP1, a first MOS transistor N1, a first resistor R1, and a second resistor R2; a non-inverting input terminal of the first operational amplifier OP1 is connected to the line voltage sampling module 11, and an inverting input terminal of the first operational amplifier OP1 is connected to a source of the first MOS transistor N1 and one end of the first resistor R1, another end of the first resistor R1 and one end of the second resistor R2 are both connected to the second source following unit 122; an output terminal of the first operational amplifier OP1 connects to a gate of the first MOS transistor N1, a drain of the first MOS transistor N1 is connected to a power, another end of the second resistor R2 is grounded. The first source following unit 121 samples the sampling voltage before obtaining the detection voltage, and outputs the detection voltage to the second source following unit 122, to facilitate to obtain the first comparison voltage.

Further, the second source following unit 122 comprises a second operational amplifier OP2, a second MOS transistor N2, a third resistor R3, and a first capacitor C1; a non-inverting input terminal of the second operational amplifier OP2 connects to another end of the first resistor R1 and one end of the second resistor R2, an inverting input terminal of the second operational amplifier OP2 connects to one end of the first capacitor C1, one end of the third resistor R3 and the judgment module 14; an output terminal of the second operational amplifier OP2 connects to a gate of the second MOS transistor N2, a drain of the second MOS transistor N2 connects to a power, a source of the second MOS transistor N2 connects to one end of the third resistor R3, another end of the third resistor R3 gets grounded, another end of the first capacitor C1 gets grounded. The second source following unit 122 samples the peak voltage of the sampling voltage before maintaining and obtaining the first comparison voltage, and outputting to the judgment unit 141, to facilitate to compare with the second comparison voltage, before determining if there is a TRIAC dimmer connected to the AC grid.

Further, the present embodiment, wherein the average voltage sampling module 13 comprises a third operational amplifier OP3, a fourth resistor R4 and a second capacitor C2; a non-inverting input terminal of the third operational amplifier OP3 connects to the line voltage sampling module 11, an inverting input terminal and an output terminal of the third operational amplifier OP3 are both connected to one end of the fourth resistor R4, another end of the fourth resistor R4 connects to one end of the second capacitor C2 and the judgment module 14, another end of the second capacitor C2 gets grounded. The average voltage sampling module 13 samples the sampling voltage before obtaining the second comparison voltage, followed by outputting the second comparison voltage to the judgment unit 141, and finishing a comparison with the first comparison voltage.

Further, the present embodiment, wherein the line voltage sampling module 11 comprises a fifth resistor R5 and a sixth resistor R6, one end of the fifth resistor R5 connects to the rectifier bridge 10, another end of the fifth resistor R5 and one end of the sixth resistor R6 are both connecting to the non-inverting input end of the first operational amplifier OP1 and the non-inverting input terminal of the third operational amplifier OP3 respectively, another end of the sixth resistor R6 gets grounded. Obtaining the sampling voltage after the line voltage sampling module 11 sampling the line voltage, before the line voltage sampling module 11 outputs the sampling voltage to the peak voltage sampling module 12 and the average voltage sampling module 13, to facilitate to obtain the first comparison voltage and the second comparison voltage respectively in a following step, and finish the detection on whether there is a TRIAC dimmer connected to the AC grid.

Further, the judgment unit 141 comprises a comparator CMP, the control unit 142 comprises an inverter INV; a non-inverting input terminal of the comparator CMP connects to peak voltage sampling module 12, while an inverting input terminal of the comparator CMP connects to the average voltage sampling module 13, an output terminal of the comparator CMP connects to an input terminal of the inverter INV, the input terminal of the inverter INV connects to the bleeder module 15. The comparator CMP outputs a high-level signal when comparing and finding out that the first comparison voltage is greater than the second comparison voltage. The high-level signal is inverted by the inverter INV to obtain a low-level signal before being output to the bleeder module 15, to control the bleeder module 15 to be turned on, which indicates that there is a TRIAC dimmer connected to the AC grid; while the comparator CMP outputs a low-level signal when comparing and finding out that the first comparison voltage is less than the second comparison voltage. The low-level signal is inverted by the inverter INV to obtain a high-level signal before being output to the bleeder module 15, to control the bleeder module 15 to be turned off, which indicates that there is no TRIAC dimmer connected to the AC grid The present embodiment, wherein recording the line voltage as Vrec, the sampling voltage as Vsen1, the second comparison voltage Vsen2, the detection voltage Vsen3, the first comparison voltage Vsen4; the line voltage is sampled by the line voltage sampling module 11 composed of the fifth resistor R5 and the sixth resistor R6 before obtaining the sampling voltage Vsen1=Vrec*R6/(R5+R6), the peak voltage of the Vsen1 is Vmax*R6/(R5+R6), the average voltage sampling module 13 samples the second comparison voltage of the Vsen1 and obtains Vsen2=(Vmax*R6/(R5+R6))$\int_{\alpha}^{\pi}$ sin θdθ.

The sampling voltage Vsen1 is sampled by the first source following unit 121 before obtaining the detection voltage Vsen3=Vsen1*R2/(R1+R2), and the detection voltage Vsen3 is sampled by the second source following unit 122 before obtaining the first comparison voltage Vsen4, wherein Vsen4 equals to the peak voltage of the Vsen3, and Vsen3=Vsen1*R2/(R1+R2), accordingly, the peak voltage of Vsen3 equals to the peak voltage of Vsen1 times R2/(R1+R2), it obtains:

$$V\text{sen}4=(V\text{max}*R6/(R5+R6))*(R2/(R1+R2))$$

Wherein R1, R2, R3, R4, R5 and R6 are a plurality of resistances of the first resistor R1, the second resistor R2, the third resistor R3, the fourth resistor R4, the fifth resistor R5, and the sixth resistor R6 respectively. Taking account of a character of the comparator CMP, and a difference caused by a distortion of the input AC voltage, the present embodiment arranges the preset value Kt=R2/(R1+R2), and Kt is slightly smaller than (2/π), preferably, selecting Kt=95%*(2/π), and it obtains:

$$Vsen4=Kt*Vmax*R6/(R5+R6);$$

When the first comparison voltage Vsen4 is larger than the second comparison voltage Vsen2, that is Kt*Vmax*R6/(R5+R6)>(Vmax*R6/(R5+R6))$\int_{\alpha}^{\pi}$ sin θdθ, which indicates the AC grid has the TRIAC dimmer connected, otherwise, the AC grid has no the TRIAC dimmer connected. Wherein first comparison voltage changes following a change of the peak voltage Vmax of the line voltage. When the AC changes, Vmax changes accordingly. Thus by comparing the first comparison voltage Vsen4 changing with the AC to the second comparison voltage Vsen2 obtained by sampling, it has a higher reliability than that obtained by a method of fixing a reference voltage, and a chance of detection error is greatly reduced.

Further, continue referencing to FIG. 3, the present embodiment, wherein the bleeder module 15 comprises a seventh resistor R7, a fourth operational amplifier OP4, a third MOS transistor N3, a fourth MOS transistor N4, and a first reference voltage source. A non-inverting input terminal of the fourth operational amplifier OP4 connects to a positive electrode of the first reference voltage source, an inverting input terminal of the fourth operational amplifier OP4 connects to a source of the third MOS transistor N3 and one end of the seventh resistor R7, while another end of the seventh resistor R7 gets grounded, an output terminal of the fourth operational amplifier OP4 connects to a gate of the third MOS transistor N3 and a drain of the fourth MOS transistor N4, and a gate of the fourth MOS transistor N4 connects to an output terminal of the inverter INV, a source of the fourth MOS transistor N4 gets grounded, and a drain of the third MOS transistor N3 connects to the rectifier bridge 10; by default, the bleeder module 15 is in an on state, when the inverter INV outputs a low-level signal, the fourth MOS transistor N4 is turned off, and the third MOS transistor N3 maintains an on state, that turns on a discharge circuit, making the TRIAC dimmer work stably. When the inverter INV outputs a high-level signal, the fourth MOS transistor N4 is turned on, and the third MOS transistor N3 is turned off, that turns off a discharge current, and reduces a power consumption while improves a system efficiency.

Further, the constant current module 16 comprises a fifth operational amplifier OP5, an eighth resistor R8, a fifth MOS transistor N5, and a second reference voltage source. A non-inverting input terminal of the fifth operational amplifier OP5 connects to an input end of the second reference voltage source. An inverting input terminal of the fifth operational amplifier OP5 connects to one end of the eighth resistor R8 and a source of the fifth MOS transistor N5, another end of the eighth resistor R8 is getting grounded, and a drain of the fifth MOS transistor N5 connects to a negative electrode of the LED light string 17, and an output terminal of the fifth operational amplifier OP5 connects to a gate of the fifth MOS transistor N5. By arranging the constant current module 16, it is possible to achieve a constant current setting of the LED light string 17.

Figure 4:
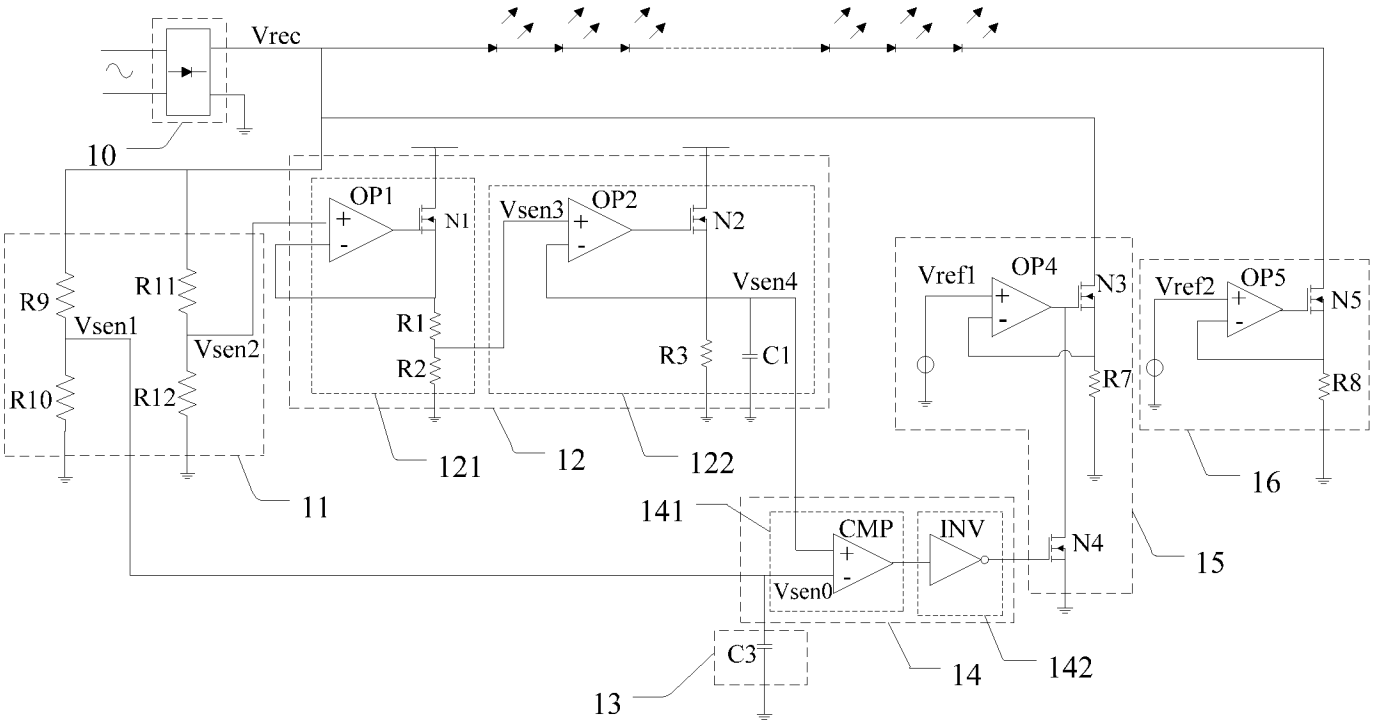
FIG. 4 illustrates a circuit schematic diagram on a second embodiment of the detection circuit of the TRIAC dimmer provided by the present disclosure.

Further, referencing to FIG. 4, a second embodiment of the present invention, wherein the average voltage sampling module 13 comprises a third capacitor C3, one end of the third capacitor C3 connects to the line voltage sampling module 11 and the judgment module 14 respectively, another end of the third capacitor C3 gets grounded. In the present embodiment, a circuit structure of the line voltage sampling module 11 and a circuit structure of the average voltage sampling module 13 in the present embodiment is different from that in the first embodiment, accordingly, the line voltage sampling module 11 comprises a ninth resistor R9, a tenth resistor R10, an eleventh resistor R11, and a twelfth resistor R12, one end of the ninth resistor R9 and one end of the eleventh resistor R11 are both connected to the rectifier bridge 10, another end of the ninth resistor R9 connects to the inverting input end of the comparator CMP, one end of the third capacitor C3, and one end of the tenth resistor R10. another end of the tenth resistor R10 gets grounded, another end of the eleventh resistor R11 and one end of the twelfth resistor R12 are both connected to the non-inverting input end of the first operational amplifier OP1, and another end of the twelfth resistor R12 gets grounded. The present embodiment, wherein the line voltage sampling module 11 outputs two sampling voltages correspondingly after sampling the line voltage, respectively, they are a first sampling voltage obtained by sampling a voltage divided by the ninth resistor R9 and the tenth resistor R10, and a second sampling voltage obtained by sampling a voltage divided by the eleventh resistor R11 and the twelfth resistor R12. After the first sampling voltage passes through the average voltage sampling module 13, the second comparison voltage is output.

The present embodiment, wherein the first sampling voltage is recorded as Vsen1, the second sampling voltage is recorded as Vsen2, the second comparison voltage is recorded as Vsen0, Vsen1=R10*Vrec/(R9+R10), Vsen2=R12*Vrec/(R11+R12), wherein R7, R8, R9 and R10 are a resistance of the seventh resistor R7, the eighth resistor R8, the ninth resistor R9, and the tenth resistor R10 respectively. In the present embodiment, the resistances of each resistor are arranged as R10/(R9+R10)=R12/(R11+R12). After the first sampling voltage passes through the average voltage sampling module 13, the second comparison voltage Vsen0=(Vmax*R10/(R9+R10))$\int_{\alpha}^{\pi}$ sin θdθ is obtained. After passing through the first source following unit 121, the second sampling voltage Vsen2 is converted to be the detection voltage Vsen3, Vsen3=Vsen2*R2/(R1+R2). After the second source following unit 122 sampling the detection voltage, the first comparison voltage Vsen4 is obtained. Vsen4 is a peak voltage of Vsen3, the peak voltage of Vsen3 equals to the peak voltage of Vsen2 times (R2/(R1+R2)), the peak voltage of Vsen2 equals to Vmax*R12/(R11+R12), it is obtained:

$$Vsen4=(Vmax*R12/(R11+R12))*(R2/(R1+R2))$$

Since R10/(R9+R10)=R12/(R11+R12), it is obtained:

$$Vsen4=(Vmax*R10/(R9+R10))*(R2/(R1+R2)).$$

Taking account of a character of the comparator CMP, and a distortion of the input AC voltage, under a condition of a structure of the peak voltage sampling module 12 is unchanged, the preset value Kt arranged in the present embodiment equals to R2/(R1+R2), while Kt is slightly less than (2/π), preferably, it is selected that Kt=95%*(2/π) it obtains:

$$Vsen4=Kt*Vmax*R10/(R9+R10)$$

When the first comparison voltage Vsen4 is greater than the second comparison voltage Vsen0, that is:

Kt*Vmax*R10/(R9+R10)>(Vmax*R10/(R9+R10))$\int_{\alpha}^{\pi}$ sin θdθ, it indicates that the AC grid has the TRIAC dimmer connected, otherwise, the AC grid has no TRIAC dimmer connected. Wherein the first comparison voltage changes following a change of the peak voltage Vmax of the line voltage, when the AC power changes, Vmax changes accordingly, Thus by comparing the first comparison voltage Vsen4 changing with the AC to the second comparison voltage Vsen2 obtained by sampling, it has a higher reliability than that obtained by a method of fixing a reference voltage, and a chance of detection error is greatly reduced.

Figure 5:
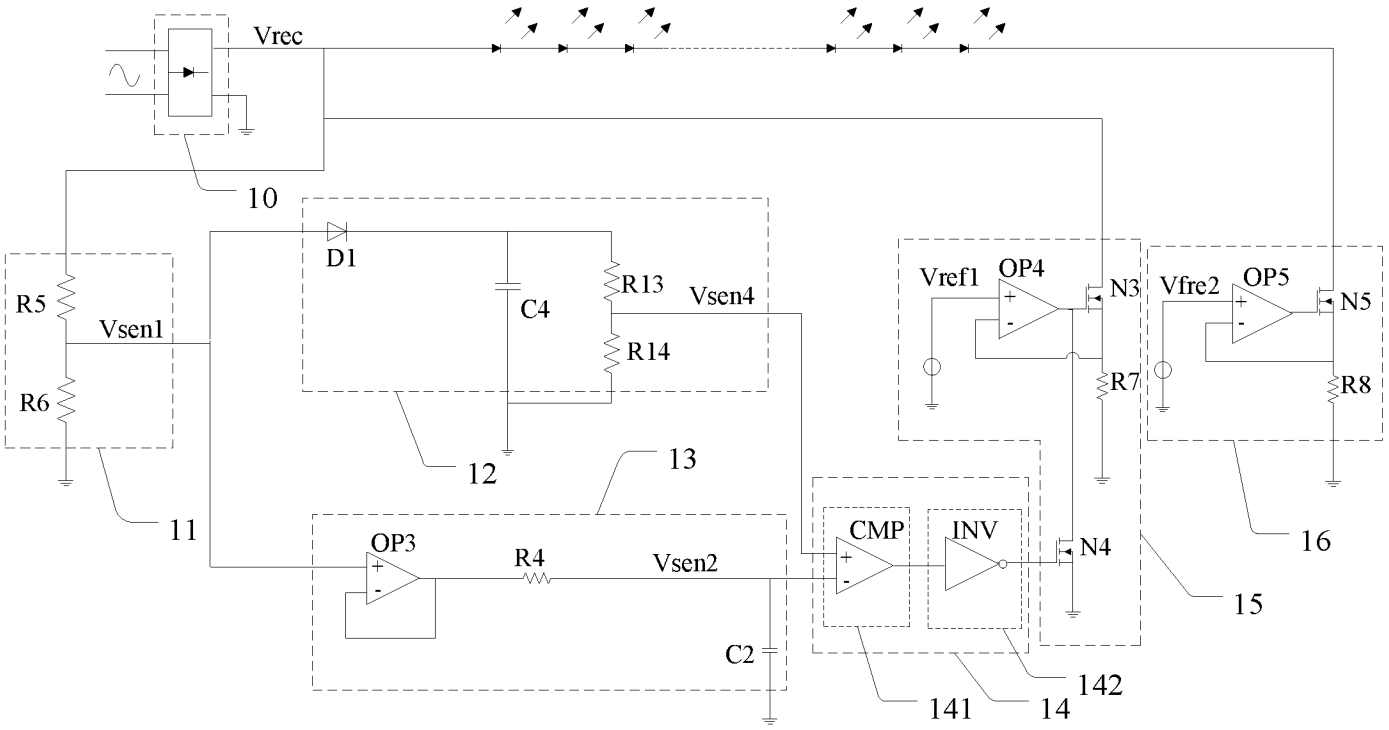
FIG. 5 illustrates a circuit schematic diagram on a third embodiment of the detection circuit of the TRIAC dimmer provided by the present disclosure.

Further, referencing to FIG. 5, a third embodiment of the present invention, wherein the peak voltage sampling module 12 comprises a diode D1, a fourth capacitor C4, a thirteenth resistor R13, and a fourteenth resistor R14, an anode of the diode D1 connects to another end of the fifth resistor R5 and one end of the sixth resistor R6, a cathode of the diode D1 connects to one end of the fourth capacitor C4 and one end of the thirteenth resistor R13, another end of the thirteenth resistor R13 and one end of the fourteenth resistor R14 connect to the non-inverting input terminal of the comparator CMP, another end of the fourteenth resistor R14 and one end of the fourth capacitor C4 are both getting grounded. Compared to the first embodiment, the peak voltage sampling module 12 in the present embodiment is different to the peak voltage sampling module 12 in the first embodiment. In the present embodiment, the peak voltage sampling module 12 obtains directly the peak voltage of the sampling voltage according to the sampling voltage, and multiplies the peak voltage of the sampling voltage by the preset value, before outputting the first comparison voltage to the judgment module 14.

Specifically, the sampling voltage is recorded as Vsen1, the second sampling voltage is recorded as Vsen2, the first comparison voltage is recorded as Vsen4, the average voltage sampling module 13 samples the sampling voltage before obtaining the second comparison voltage Vsen2=(Vmax*R6/(R5+R6))$\int_{\alpha}^{\pi}$ sin θdθ. In the present embodiment, the diode D1 is an isolation diode with a small voltage drop, such as a Schottky diode, and the peak voltage sampling module 12 samples the sampling voltage before obtaining the first comparison voltage:

$$Vsen4=((Vmax*R6/(R5+R6))-Vd1)*(R14/(R13+R14))$$

Wherein Vd1 is a voltage difference of the diode D1. Taking into account an influence of the characteristic of the comparator CMP, the distortion of the input AC voltage and the voltage difference Vd1 of the diode D1, the peak voltage sampling module 12 in the present embodiment is different to that in the first implementation, accordingly, it arranges the preset value Kt=R14/(R13+R14), and Kt is slightly less than (2/π), preferably Kt=95%*(2/π), it obtains:

$$Vsen4=Kt*((Vmax*R6/(R5+R6))-Vd1)$$

When the first comparison voltage Vsen4 is greater than the second comparison voltage Vsen2, that is Kt*((Vmax*R6/(R5+R6))−Vd1)>(Vmax*R6/(R5+R6)) $\int_{\alpha}^{\pi}$ sin θdθ, which indicates that the AC grid has the TRIAC dimmer connected, otherwise the AC grid has no TRIAC dimmer connected. Wherein, the first comparison voltage changes following the change of the peak voltage Vmax of the line voltage. When the AC changes, Vmax changes accordingly. Thus by comparing the first comparison voltage Vsen4 changing with the AC to the second comparison voltage Vsen2 obtained by sampling, it has a higher reliability than that obtained by a method of fixing a reference voltage, and a chance of detection error is greatly reduced.

Figure 6:
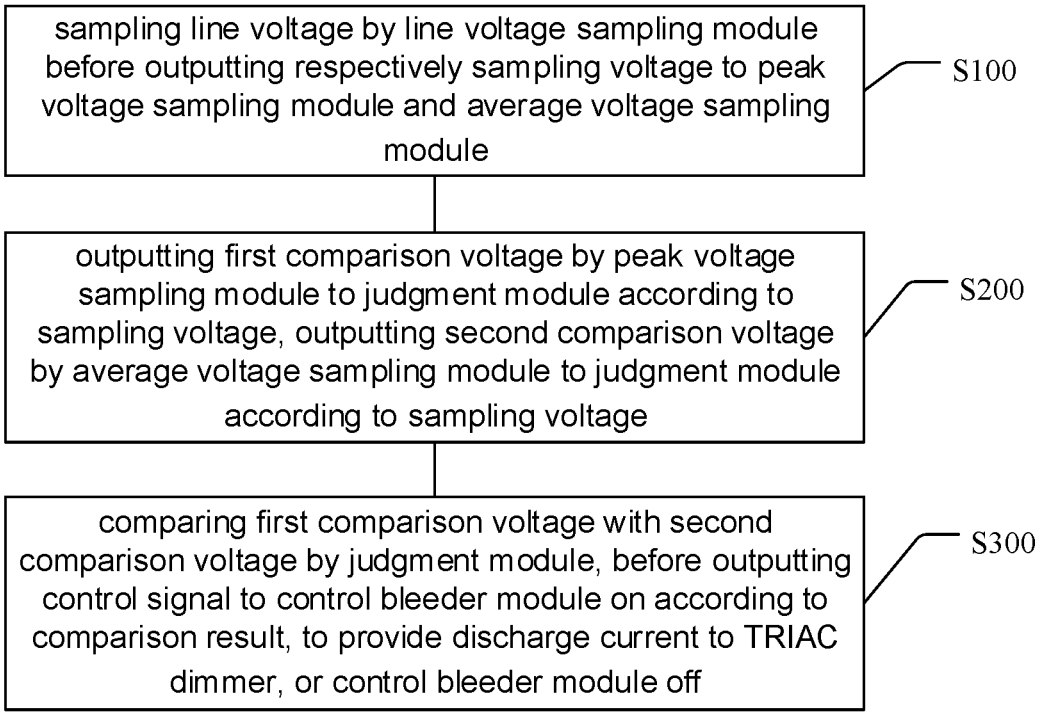
FIG. 6 illustrates a flow chart on the steps of the detection method of the detection circuit of the TRIAC dimmer provided by the present disclosure.

Further, based on the detection circuit of the TRIAC dimmer stated above, the present invention further discloses a detection method of the TRIAC dimmer, referencing to FIG. 6, the detection method comprises a plurality of following steps:

S100, sampling the line voltage by the line voltage sampling module before outputting respectively a sampling voltage to the peak voltage sampling module and the average voltage sampling module;

S200, outputting a first comparison voltage by the peak voltage sampling module to the judgment module according to the sampling voltage, outputting a second comparison voltage by the average voltage sampling module to the judgment module according to the sampling voltage;

S300, comparing the first comparison voltage with the second comparison voltage by the judgment module, before outputting a control signal to control the bleeder module on according to a comparison result, to provide a discharge current to the TRIAC dimmer, or control the bleeder module off.

Further, the present invention further discloses a detection device for the TRIAC dimmer, comprising a PCB, the PCB has the detection circuit of the TRIAC dimmer stated above arranged thereon. Since the circuit has been described in details above, thus no more details will be stated herein.

All above, the present disclosure provides a detection circuit and a device for a TRIAC dimmer and a detection method thereof. The detection circuit comprises a line voltage sampling module, a peak voltage sampling module, an average voltage sampling module, a judgment module and a bleeder module, wherein the line voltage sampling module is applied to sampling the line voltage before outputting respectively a sampling voltage to the peak voltage sampling module and the average voltage sampling module; the peak voltage sampling module outputs a first comparison voltage to the judgment module according to the sampling voltage, and the average voltage sampling module outputs a second comparison voltage to the judgment module according to the sampling voltage; the judgment module is applied to comparing the first comparison voltage with the second comparison voltage before outputting a control signal according to a comparison result to control the bleeder module on or off; and the bleeder module is applied to providing a discharge current to the TRIAC dimmer when being on. The present disclosure is able to solve effectively the problem that the detection result for the TRIAC dimmer is unreliable when an average voltage value is changed while a reference voltage is not changed due to a fluctuation of the AC grid voltage, and a detection accuracy is improved.

It should be understood that, the application of the present disclosure is not limited to the above examples listed. Ordinary technical personnel in this field can improve or change the applications according to the above descriptions, all of these improvements and transforms should belong to the scope of protection in the appended claims of the present disclosure.

What is claimed is:

1. A detection circuit of a TRIAC dimmer, comprising:

a line voltage sampling module;

a peak voltage sampling module;

an average voltage sampling module;

a judgment module; and a bleeder module;

wherein the line voltage sampling module is applied to sampling a line voltage before outputting, respectively, a sampling voltage to the peak voltage sampling module and the average voltage sampling module;

wherein the peak voltage sampling module is applied to outputting a first comparison voltage to the judgment module according to the sampling voltage, and the average voltage sampling module is applied to outputting a second comparison voltage to the judgment module according to the sampling voltage;

wherein the judgment module is applied to comparing the first comparison voltage with the second comparison voltage, before outputting a control signal to control an on or off of the bleeder module according to a comparison result; and wherein the bleeder module is applied to providing a discharge current for the TRIAC dimmer when being on.

2. The detection circuit according to claim 1, wherein the peak voltage sampling module is applied specifically to multiplying a peak voltage of the sampling voltage by a preset value before outputting the first comparison voltage to the judgment module.

3. The detection circuit according to claim 2, wherein the peak voltage sampling module comprises a first source following unit and a second source following unit, wherein the first source following unit is applied to multiplying the sampling voltage by a preset value before outputting the detection voltage to the second source following unit, and wherein the second source following unit is applied to obtaining a peak voltage of the detection voltage according to the detection voltage, before outputting the first comparison voltage to the judgment module.

4. The detection circuit according to claim 1, wherein the judgment module comprises a judgment unit and a control unit, wherein the judgment unit is applied to outputting a first comparison signal to the control unit when judging the first comparison voltage larger than the second comparison voltage, and outputting a second comparison signal to the control unit when judging the first comparison voltage smaller than the second comparison voltage, wherein the control unit is applied to controlling the bleeder module on according to the first comparison signal, or controlling the bleeder module off according to the second comparison signal.

5. The detection circuit according to claim 3, wherein the first source following unit comprises:

a first operational amplifier;

a first MOS transistor;

a first resistor; and a second resistor; and wherein a non-inverting input terminal of the first operational amplifier is connected to the line voltage sampling module, and an inverting input terminal of the first operational amplifier is connected to a source of the first MOS transistor and one end of the first resistor, another end of the first resistor and one end of the second resistor are both connected to the second source following unit; and wherein an output terminal of the first operational amplifier connects to a gate of the first MOS transistor, a drain of the first MOS transistor is connected to a power, another end of the second resistor gets grounded.

6. The detection circuit according to claim 5, wherein the second source following unit comprises:

a second operational amplifier;

a second MOS transistor;

a third resistor; and a first capacitor;

wherein a non-inverting input terminal of the second operational amplifier connects to another end of the first resistor and one end of the second resistor, and an inverting input terminal of the second operational amplifier connects to one end of the first capacitor, one end of the third resistor and the judgment module; and wherein an output terminal of the second operational amplifier connects to a gate of the second MOS transistor, a drain of the second MOS transistor connects to a power, a source of the second MOS transistor connects to one end of the third resistor, another end of the third resistor gets grounded, another end of the first capacitor gets grounded.

7. The detection circuit according to claim 1, wherein the average voltage sampling module comprises:

a third operational amplifier;

a fourth resistor; and a second capacitor;

wherein a non-inverting input terminal of the third operational amplifier connects to the line voltage sampling module, an inverting input terminal and an output terminal of the third operational amplifier are both connected to one end of the fourth resistor, another end of the fourth resistor connects to one end of the second capacitor and the judgment module, another end of the second capacitor gets grounded.

8. The detection circuit according to claim 6, wherein the average voltage sampling module comprises:

a third operational amplifier;

a fourth resistor; and a second capacitor;

wherein a non-inverting input terminal of the third operational amplifier connects to the line voltage sampling module, an inverting input terminal and an output terminal of the third operational amplifier are both connected to one end of the fourth resistor, another end of the fourth resistor connects to one end of the second capacitor and the judgment module, another end of the second capacitor gets grounded.

9. The detection circuit according to claim 6, wherein the average voltage sampling module comprises a third capacitor, wherein one end of the third capacitor connects to the line voltage sampling module and the judgment module respectively, and another end of the third capacitor gets grounded.

10. A detection method according to the detection circuit stated in claim 1, wherein comprising a plurality of following steps:

sampling the line voltage by the line voltage sampling module before outputting respectively a sampling voltage to the peak voltage sampling module and the average voltage sampling module;

outputting a first comparison voltage by the peak voltage sampling module to the judgment module according to the sampling voltage, outputting a second comparison voltage by the average voltage sampling module to the judgment module according to the sampling voltage; and comparing the first comparison voltage with the second comparison voltage by the judgment module, before outputting a control signal to control the bleeder module on according to a comparison result, to provide a discharge current to the TRIAC dimmer, or control the bleeder module off.

11. A detection device for a TRIAC dimmer, comprising a PCB, wherein the PCB has the detection circuit according to claim 1 arranged thereon.

* * * * *